US006762640B2

(12) United States Patent
Katsuhisa

(10) Patent No.: US 6,762,640 B2
(45) Date of Patent: Jul. 13, 2004

(54) BIAS VOLTAGE GENERATING CIRCUIT AND SEMICONDUCTOR INTEGRATED CIRCUIT DEVICE

(75) Inventor: Takuji Katsuhisa, Kanagawa (JP)

(73) Assignee: NEC Electronics Corporation, Kawasaki (JP)

( * ) Notice: Subject to any disclaimer, the term of this patent is extended or adjusted under 35 U.S.C. 154(b) by 0 days.

(21) Appl. No.: 10/419,887

(22) Filed: Apr. 22, 2003

(65) Prior Publication Data

US 2003/0201820 A1 Oct. 30, 2003

(30) Foreign Application Priority Data

Apr. 24, 2002 (JP) ..... 2002-122829

(51) Int. Cl.[7] ..... G05F 3/16
(52) U.S. Cl. ..... 327/536; 327/537; 363/60
(58) Field of Search ..... 327/536, 537; 363/60; 365/189.09, 226

(56) References Cited

U.S. PATENT DOCUMENTS 5,502,415 A * 3/1996 Matsui et al. ..... 327/536
5,748,032 A * 5/1998 Baek ..... 327/536
2003/0080803 A1 * 5/2003 Komiya et al. ..... 327/536

FOREIGN PATENT DOCUMENTS

JP 9-106675 4/1997 ..... G11C/11/407

* cited by examiner

*Primary Examiner*—Timothy P. Callahan
*Assistant Examiner*—Terry L. Englund
(74) *Attorney, Agent, or Firm*—McGinn & Gibb, PLLC

(57) ABSTRACT

A bias voltage generating circuit operates such that when a signal CKA rises to a potential VCC and a signal CKB falls to a ground potential GND, the potential of the interconnect line 12 decreases from the potential 2.times.VCC to the potential VCC, turning a transistor NT4 to an OFF-state. When a signal CKC rises to the potential VCC after the signal CKB has fallen to the ground potential GND, the potential of the interconnect line 13 increases by the magnitude of VCC to the potential 2.times.VCC. Subsequently, when a signal CKD rises to the potential VCC, the potential of the interconnect line 14 increases from the potential VCC to the potential 2.times.VCC, turning a transistor NT5 to an ON-state, and then the output from an output terminal VOUT increases up to the potential 2.times.VCC−(Vt+ΔV) and keeps the same potential.

13 Claims, 11 Drawing Sheets

BIAS VOLTAGE GENERATING CIRCUIT AND SEMICONDUCTOR INTEGRATED CIRCUIT DEVICE

BACKGROUND OF THE INVENTION

1. Field of the Invention

The present invention relates to a bias voltage generating circuit, and particularly to a bias voltage generating circuit for generating a voltage higher than a power supply voltage or lower than the ground voltage and a semiconductor integrated circuit device incorporating therein the bias voltage generating circuit.

2. Description of Related Art

Recently, in order to reduce the power consumption of semiconductor integrated circuit, efforts have been made to lower the voltage level of power supply. As the voltage level of power supply decreases, the absolute value of a threshold voltage of MOS transistor gradually decreases. However, since increase in power consumption during a standby mode needs to be suppressed, an extent to which the threshold voltage of MOS transistor is lowered is forced to become smaller than that to which the voltage level of power supply is lowered. Particularly, in Dynamic Random-Access Memory (DRAM), to maintain a desired hold time for data latch, it is not desirable to reduce the threshold voltage of a transistor within a memory cell unit. However, when the voltage level of power supply is lowered and yet the threshold voltage is maintained at the same level as that used before the voltage level of power supply is lowered, a rate at which DRAM operates cannot be made higher. Accordingly, for example, a technique for supplying a voltage higher than a power supply voltage to a part of DRAM, such as a drive circuit for a word line, in order to make DRAM operate at a higher rate is employed.

FIG. 1 is a circuit diagram illustrating a bias voltage generating circuit disclosed in Japanese Patent Application Laid-open No. 9-106675 (1997). The conventional bias voltage generating circuit includes: an N-channel MOS transistor NT11 having a drain and a gate connected to a power terminal VCC for supplying a specific positive voltage and a backgate connected to ground; an N-channel MOS transistor NT12 having a drain and a gate connected to the power terminal VCC and a backgate connected to ground; an N-channel MOS transistor NT13 having a drain connected to the source of the N-channel MOS transistor NT11 via the interconnect line 61, a gate connected to the source of the N-channel MOS transistor NT12 via the interconnect line 62, a source connected to a bias voltage output terminal VOUT, and a backgate connected to a ground terminal GND; a capacitive element C11 having one end connected to the source of the N-channel MOS transistor NT11 via the interconnect line 61; and a capacitive element C12 having one end connected to the source of the N-channel MOS transistor NT12 via the interconnect line 62. Note that a capacitive element C0 is provided to stabilize a bias-voltage output from the bias voltage generating circuit.

The bias voltage generating circuit shown in FIG. 1 increases or boosts a voltage to a desired voltage level in the following manner. That is, an original clock signal CLK is configured to alternately have high levels and low levels at a specific time interval and the original clock signal is modified to present a clock signal having an amplitude corresponding to a difference between a potential at the power terminal VCC and ground potential, and then, the clock signal is supplied to the other end of the capacitive element C11 and the other end of the capacitive element C12.

FIG. 2 is a timing diagram of how the bias voltage generating circuit operates. FIG. 2 illustrates how a bias voltage output from the circuit returns to its steady-state voltage when the bias voltage is increased to its steady-state voltage and then, for example, current flows from the bias voltage generating circuit to the outside upon selection of a word line, lowering the bias voltage.

Hereinafter, an electric potential (hereinafter, referred to simply as potential) at the power terminal VCC is simply denoted by VCC and a potential at the ground terminal GND is simply denoted by GND. Furthermore, assume that a threshold voltage is defined as Vt when the backgate voltage of N-channel MOS transistor is zero (i. e., a potential difference calculated by subtracting the potential at source from the potential at backgate is zero) and an increase to Vt in the threshold voltage is defined as ΔV when the potential at backgate is lowered to −VCC relative to the potential at source (i. e., a potential difference calculated by subtracting the potential at source from the potential at backgate is −VCC).

Referring to FIG. 2, when the original clock signal CLK is at a low level, the potential of the interconnect line 61 is represented by VCC−(Vt+ΔV) and likewise, the potential of the interconnect line 62 is represented by VCC−(Vt+ΔV). In this case, the potential at a bias voltage output terminal VOUT is assumed to be lower than its steady-state voltage.

When the original clock signal CLK changes to a high level, the clock signal supplied to the other end of the capacitive element C11 rises from GND to VCC after a little time elapses from the moment the signal CLK changes and therefore, the potential of the interconnect line 61 increases up to 2.times.VCC−(Vt+ΔV). Furthermore, since the clock signal supplied to the other end of the capacitive element C12 rises from GND to VCC, the potential of the interconnect line 62 also increases up to 2.times.VCC−(Vt+ΔV), turning the N-channel MOS transistor NT13 to an ON-state.

When the N-channel MOS transistor NT13 becomes turned on, since an electric charge in the interconnect line 61 moves to the bias voltage output terminal VOUT via the N-channel MOS transistor NT13, the potential at the bias voltage output terminal VOUT increases up to the potential of the interconnect line 61 less the threshold voltage (Vt+ΔV) of the N-channel MOS transistor NT13, i. e., 2.times.VCC−2.times.(Vt+ΔV), and the potential of the interconnect line 61 decreases down to 2.times.VCC2.times.(Vt+ΔV).

When the original clock signal CLK changes back to a low level, the clock signal supplied to the other end of the capacitive element C1 decreases from VCC to GND after a little time elapses from the moment the signal CLK changes and therefore, the potential of the interconnect line 62 decreases down to VCC−(Vt+ΔV). Furthermore, although the clock signal supplied to the other end of the capacitive element C12 decreases from VCC to GND and accordingly, the potential of the interconnect line 62 once decreases down to VCC−2.times.(Vt+ΔV), the potential of the interconnect line 62 is charged by the N-channel MOS transistor NT12 and then returns to VCC−(Vt+ΔV).

When current does not flow from the bias voltage generating circuit to the outside, the potential at the bias voltage output terminal VOUT keeps its steady-state potential, i. e., 2.times.VCC−2.times.(Vt+ΔV). When current flows from the bias voltage generating circuit to the outside and then the potential at the bias voltage output terminal VOUT becomes lower than its steady-state potential, the potential at the bias voltage output terminal VOUT again returns to 2.times.VCC−2.times.(Vt+ΔV) at the moment the subsequent original clock signal CLK changes to a high level, as is explained in the aforementioned description.

As described above, the conventional bias voltage generating circuit shown in FIG. 1 is able to generate a bias voltage of 2.times.VCC−2.times.(Vt+ΔV) in its steady-state condition. However, a power supply voltage has increasingly been lowered and in contrast, a threshold voltage inevitably has been gently lowered, as is already described. Accordingly, a difference between a bias voltage generated by the conventional bias voltage generating circuit and a power supply voltage is becoming smaller, eliminating beneficial effects produced by increase in bias voltage. This causes a strong need for a bias voltage generating circuit capable of generating a higher bias voltage.

Moreover, in some cases, a bias voltage generating circuit for generating a negative voltage potential lower than ground potential is employed and a threshold voltage of a MOS transistor having a low threshold voltage is controlled by applying the negative voltage potential to the MOS transistor to reduce leakage current between source and drain of the MOS transistor during a standby mode. The bias voltage generating circuit employed in such an application needs to generate a large negative voltage.

SUMMARY OF THE INVENTION

The present invention has been conceived in consideration of the above-described requirements and is directed to a bias voltage generating circuit that is configured to generate a bias voltage higher than a power supply voltage and improved to be able to generate a bias voltage higher than what is achieved when employing a conventional technique, or is directed to a bias voltage generating circuit that is configured to generate a bias voltage lower than a ground voltage and improved to be able to generate a bias voltage lower than what is achieved when employing a conventional technique.

A bias voltage generating circuit according to the first aspect of the present invention comprises:

- a first power terminal for receiving a first voltage from outside;
- a second power terminal for receiving a second voltage from outside;
- a bias voltage output terminal for outputting a bias voltage to the outside;
- a first MOS transistor having a drain and a gate connected to the first power terminal and a backgate connected to the second power terminal;
- a second MOS transistor having a drain connected to the first power terminal, a gate connected to the source of the first MOS transistor, and a backgate connected to the second power terminal;
- a third MOS transistor having a drain connected to the first power terminal, a gate connected to the source of the first MOS transistor, and a backgate connected to the second power terminal;
- a fourth MOS transistor having a drain connected to the first power terminal, a gate connected to the source of the second MOS transistor, and a backgate connected to the second power terminal;
- a fifth MOS transistor having a drain connected to the source of the third MOS transistor, a gate connected to the source of the fourth MOS transistor, a source connected to the bias voltage output terminal, and a backgate connected to the first power terminal;
- a first capacitive element having one end connected to the source of the first MOS transistor and the other end for receiving a first clock signal;
- a second capacitive element having one end connected to the source of the second MOS transistor and the other end for receiving a second clock having a phase opposite to that of the first clock signal;
- a third capacitive element having one end connected to the source of the third MOS transistor and the other end for receiving a third clock signal; and
- a fourth capacitive element having one end connected to the source of the fourth MOS transistor and the other end for receiving a fourth clock signal.

A bias voltage generating circuit according to the second aspect of the present invention comprises:

- a first power terminal for receiving a first voltage from outside;
- a second power terminal for receiving a second voltage from outside;
- a bias voltage output terminal for outputting a bias voltage to the outside;
- a first MOS transistor having a drain and a gate connected to the first power terminal and a backgate connected to the second power terminal;
- a second MOS transistor having a drain connected to the first power terminal, a gate connected to the source of the first MOS transistor, and a backgate connected to the second power terminal;
- a third MOS transistor having a drain connected to the first power terminal, a gate connected to the source of the first MOS transistor, and a backgate connected to the second power terminal;
- a fourth MOS transistor having a drain connected to the first power terminal, a gate connected to the source of the second MOS transistor, and a backgate connected to the second power terminal;
- a fifth MOS transistor having a drain connected to the source of the third MOS transistor, a gate connected to the source of the fourth MOS transistor, a source connected to the bias voltage output terminal;
- a sixth MOS transistor having a drain connected to the first power terminal, a gate connected to the source of the second MOS transistor, a source connected to a backgate of the fifth MOS transistor, and a backgate connected to the second power terminal;
- a seventh MOS transistor having a drain connected to the source of the third MOS transistor, a gate connected to the source of the second MOS transistor, a source connected to the backgate of the fifth MOS transistor, and a backgate connected to the second power terminal;
- an eighth MOS transistor having a drain connected to the source of the fifth MOS transistor, a gate connected to the source of the third MOS transistor, a source connected to the backgate of the fifth MOS transistor, and a backgate connected to the second power terminal;
- a first capacitive element having one end connected to the source of the first MOS transistor and the other end for receiving a first clock signal;
- a second capacitive element having one end connected to the source of the second MOS transistor and the other end for receiving a second clock having a phase opposite to that of the first clock signal;
- a third capacitive element having one end connected to the source of the third MOS transistor and the other end for receiving a third clock signal; and a fourth capacitive element having one end connected to the source of the fourth MOS transistor and the other end for receiving a fourth clock signal.

A semiconductor integrated circuit device according to the third aspect of the present invention comprises a bias voltage generating circuit, in which the bias voltage generating circuit includes:

a power terminal for receiving a specific positive voltage;

a ground terminal for receiving a ground voltage;

a bias voltage output terminal for outputting a bias voltage;

a first N-channel MOS transistor having a drain and a gate connected to the power terminal and a backgate connected to the ground terminal;

a second N-channel MOS transistor having a drain connected to the power terminal, a gate connected to the source of the first N-channel MOS transistor, and a backgate connected to the ground terminal;

a third N-channel MOS transistor having a drain connected to the power terminal, a gate connected to the source of the first N-channel MOS transistor, and a backgate connected to the ground terminal;

a fourth N-channel MOS transistor having a drain connected to the power terminal, a gate connected to the source of the second N-channel MOS transistor, and a backgate connected to the ground terminal;

a fifth N-channel MOS transistor having a drain connected to the source of the third N-channel MOS transistor, a gate connected to the source of the fourth N-channel MOS transistor, a source connected to the bias voltage output terminal;

a sixth N-channel MOS transistor having a drain connected to the power terminal, a gate connected to the source of the second N-channel MOS transistor, a source connected to a backgate of the fifth N-channel MOS transistor, and a backgate connected to the ground terminal;

a seventh N-channel MOS transistor having a drain connected to the source of the third N-channel MOS transistor, a gate connected to the source of the second N-channel MOS transistor, a source connected to the backgate of the fifth N-channel MOS transistor, and a backgate connected to the ground terminal; and an eighth N-channel MOS transistor having a drain connected to the source of the fifth N-channel MOS transistor, a gate connected to the source of the third N-channel MOS transistor, a source connected to the backgate of the fifth N-channel MOS transistor, and a backgate connected to the ground terminal.

The aforementioned objects, other objects associated therewith and features of the invention will be apparent from the following detailed description with reference to the attached drawings and from new matters disclosed in the claims.

BRIEF DESCRIPTION OF THE DRAWINGS

In order to give a better understanding of the drawings used in the detailed description of the invention, each of the drawings is briefly explained. In the drawing.

DETAILED DESCRIPTION OF THE PREFERRED EMBODIMENTS

Preferred embodiments of the present invention will be explained in detail below with reference to the accompanying drawings. Note that the invention explained below may be embodied in many different forms and should not be construed as limited to the preferred embodiments set forth herein.

Figure 3:
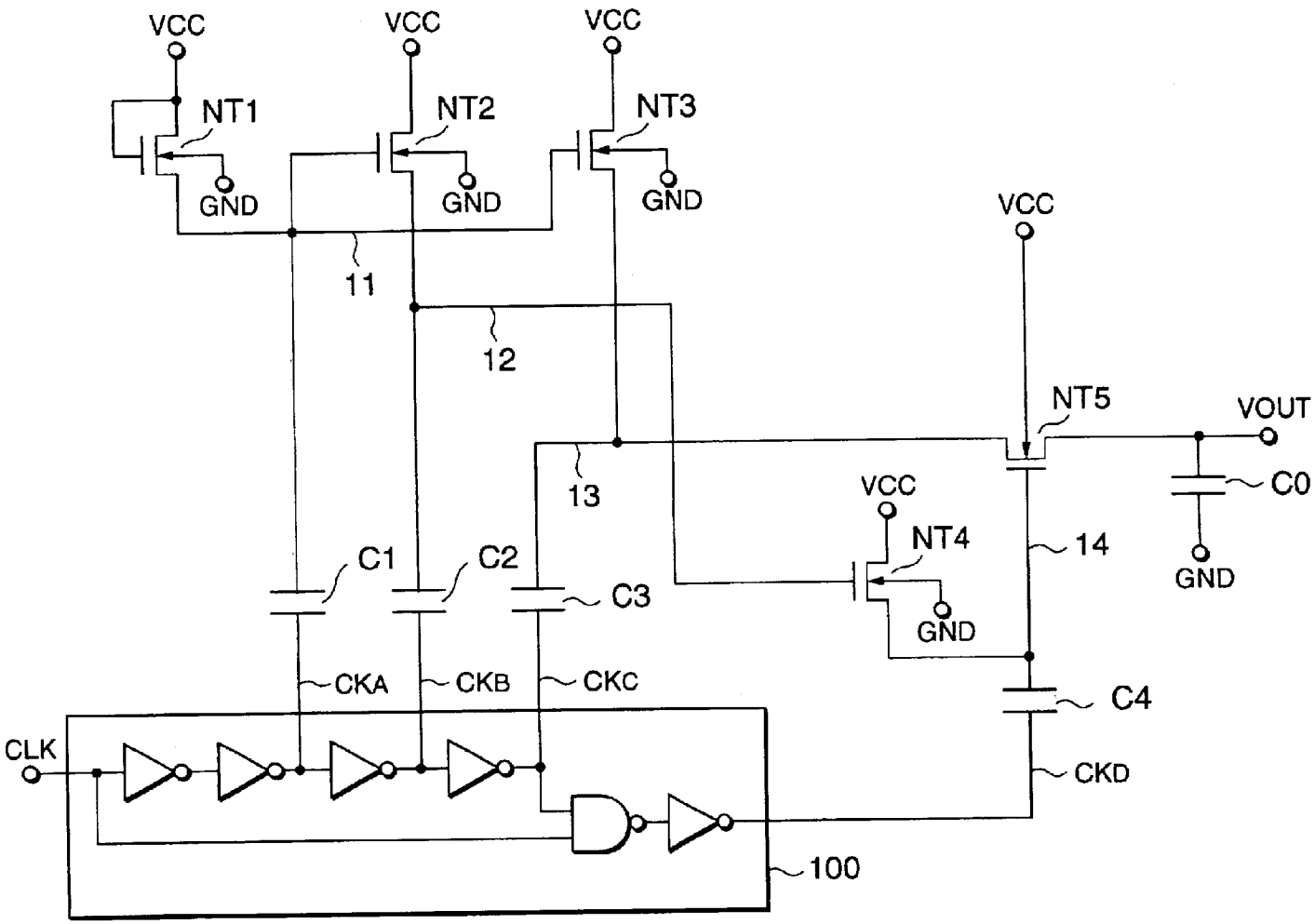
FIG. 3 is a circuit diagram of a bias voltage generating circuit according to a first embodiment of the invention.

FIG. 3 is a circuit diagram of a bias voltage generating circuit according to a first embodiment of the invention. Referring to FIG. 3, the bias voltage generating circuit includes N-channel MOS transistors NT1, NT2, NT3, NT4 and NT5, and capacitive elements C1, C2, C3 and C4.

The N-channel MOS transistor NT1 has a drain and a gate connected to a power terminal VCC for supplying a specific positive voltage, and a backgate connected to a ground terminal GND.

The N-channel MOS transistor NT2 has a drain connected to the power terminal VCC, a gate connected to the source of the N-channel MOS transistor NT1 via the interconnect line 11, and a backgate connected to the ground terminal GND.

The N-channel MOS transistor NT3 has a drain connected to the power terminal VCC, a gate connected to the source of the N-channel MOS transistor NT1 via the interconnect line 11, and a backgate connected to the ground terminal GND.

The N-channel MOS transistor NT4 has a drain connected to the power terminal VCC, a gate connected to the source of the N-channel MOS transistor NT2 via the interconnect line 12, and a backgate connected to the ground terminal GND.

The N-channel MOS transistor NT5 has a drain connected to the source of the N-channel MOS transistor NT3 via the interconnect line 13, a gate connected to the source of the N-channel MOS transistor NT4 via the interconnect line 14, a source connected to a bias voltage output terminal VOUT, and a backgate connected to the power terminal VCC.

The capacitive element C1 has one end connected to the source of the N-channel MOS transistor NT1 via the interconnect line 11 and the other end to which a clock signal CKA as a first clock signal is supplied.

The capacitive element C2 has one end connected to the source of the N-channel MOS transistor NT2 via the interconnect line 12 and the other end to which a clock signal CKB as a second clock signal having a phase opposite to that of the clock signal CKA is supplied.

The capacitive element C3 has one end connected to the source of the N-channel MOS transistor NT3 via the interconnect line 13 and the other end to which a clock signal CKC as a third clock signal is supplied.

The capacitive element C4 has one end connected to the source of the N-channel MOS transistor NT4 via the interconnect line 14 and the other end to which a clock signal CKD as a fourth clock signal is supplied.

It should be noted that a capacitive element C0 is provided to stabilize a bias voltage to be output. The clock signal CKC begins rising after the clock signal CKA begins rising and the clock signal CKD begins rising after the clock signal CKB begins falling and begins falling before the clock signal CKC begins falling. The clock signals CKA, CKB, CKC and CKD are produced, for example, by a clock generating circuit 100 based on the original clock signal CLK.

Figure 2:
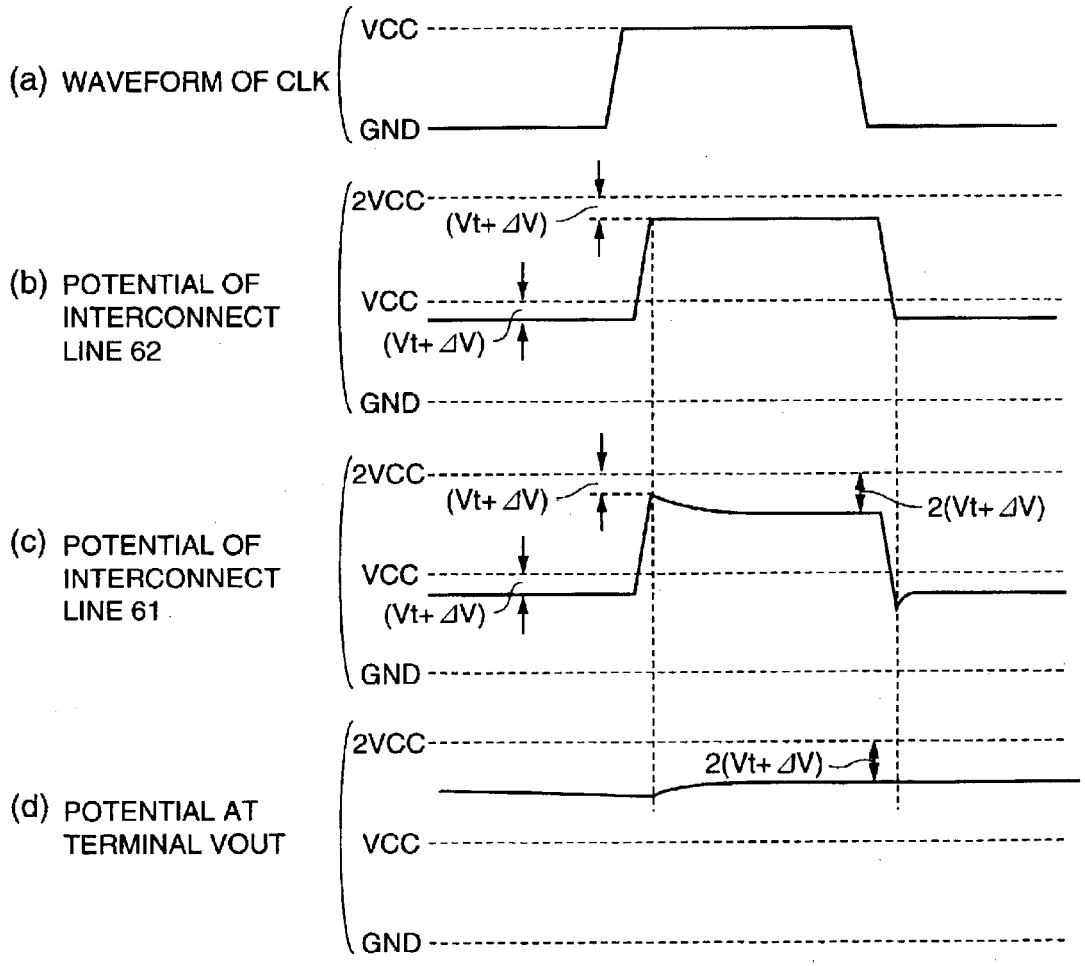
FIG. 2 PRIOR ART
FIG. 2 is a timing diagram of how the conventional bias voltage generating circuit operates.
Figure 4:
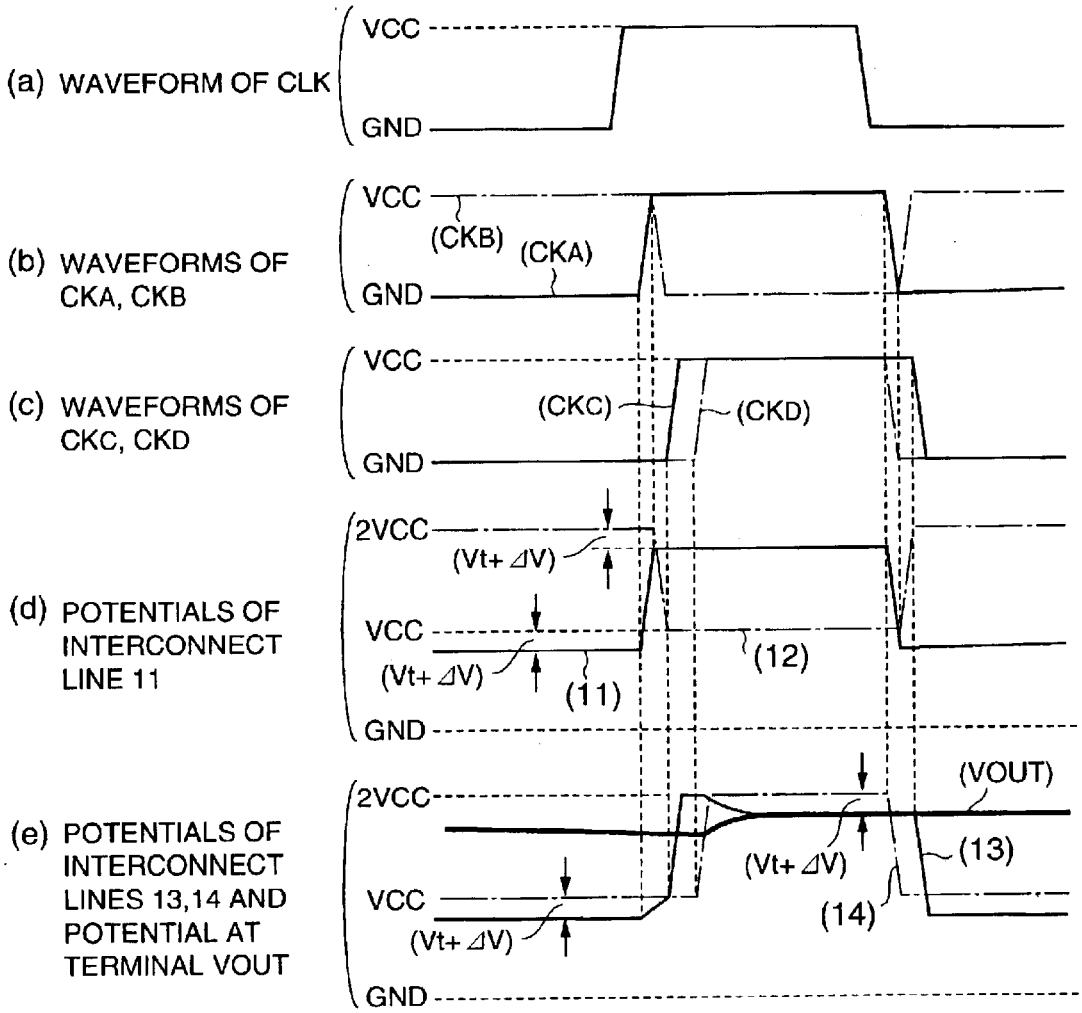
FIG. 4 is a timing diagram of how the bias voltage generating circuit of the first embodiment operates.

FIG. 4 is a timing diagram of how the bias voltage generating circuit of the embodiment operates. FIG. 4 illustrates how a bias voltage output from the circuit returns to its steady-state bias voltage when the bias voltage output from the circuit is increased to its steady-state voltage and then current flows from the bias voltage generating circuit to the outside, lowering the bias voltage, which operation is explained in the description of the conventional bias voltage generating circuit shown in FIG. 2.

As is the case in the description of the conventional bias voltage generating circuit, a potential at the power terminal VCC is simply denoted by VCC and a potential at the ground terminal GND is simply denoted by GND. Furthermore, assume that a threshold voltage is defined as Vt when the backgate voltage of N-channel MOS transistor is zero relative to the potential at source and an increase to Vt in the threshold voltage is defined as ΔV when the potential at backgate is lowered to —VCC relative to the potential at source.

Referring to FIG. 4, when the original clock signal CLK is at a low level, the clock signal CKA is at the potential GND, the clock signal CKB is at the potential VCC, the clock signal CKC is at the potential GND, and the clock signal CKD is at the potential GND. Furthermore, the interconnect line 11 is at the potential VCC−(Vt+ΔV), the interconnect line 12 is at the potential 2.times.VCC, the interconnect line 13 is at the potential VCC−(Vt+ΔV). At this moment, the voltage of a bias voltage output terminal VOUT is assumed to be lower than its steady-state voltage.

When the original clock signal CLK changes to a high level, the clock signal CKA rises to the potential VCC and the clock signal CKB falls to the potential GND. This turns the N-channel MOS transistor NT3 to an ON-state and then increases the potential of the interconnect line 13 from VCC−(Vt+ΔV) to VCC while decreasing the potential of the interconnect line 12 from 2.times.VCC to VCC, thereby turning the N-channel MOS transistor NT4 to an OFF-state. When the clock signal CKC rises to the potential VCC after the clock signal CKB has fallen to the potential GND, the potential of the interconnect line 13 increases by the magnitude of VCC to 2.times.VCC. Subsequently, when the clock signal CKD rises to the potential VCC, the potential of the interconnect line 14 increases from VCC to 2.times.VCC, turning the N-channel MOS transistor NT5 to an ON-state.

When the N-channel MOS transistor NT5 becomes turned on, since an electric charge in the interconnect line 13 moves to the bias voltage output terminal VOUT via the N-channel MOS transistor NT5, the potential at the bias voltage output terminal VOUT increases up to 2.times.VCC on the interconnect line 14 less the threshold voltage (Vt+ΔV) of the N-channel MOS transistor NT5, i. e., 2.times.VCC−(Vt+ΔV), and the potential of the interconnect line 13 decreases down to 2.times.VCC−(Vt+ΔV).

When the original clock signal CLK changes back to a low level, first, the clock signal CKD changes to the potential GND, turning the N-channel MOS transistor NT5 to an OFF-state. Furthermore, the clock signal CKA falls to the potential GND, turning the N-channel MOS transistors NT2 and NT3 to an OFF-state. Since the clock signal CKB rises to the potential VCC, the potential of the interconnect line 12 increases to 2.times.VCC, turning the N-channel MOS transistor NT4 to an ON-state. Subsequently, when the clock signal CKC falls to the potential GND, the potential of the interconnect line 13 falls from 2.times.VCC−(Vt+ΔV) to VCC−(Vt+ΔV). At the moment, since the N-channel MOS transistor NT5 is already in an OFF-state, an electric charge never flows in a reverse direction, i. e., a direction from the bias voltage output terminal VOUT to the interconnect line 13.

Figure 1:
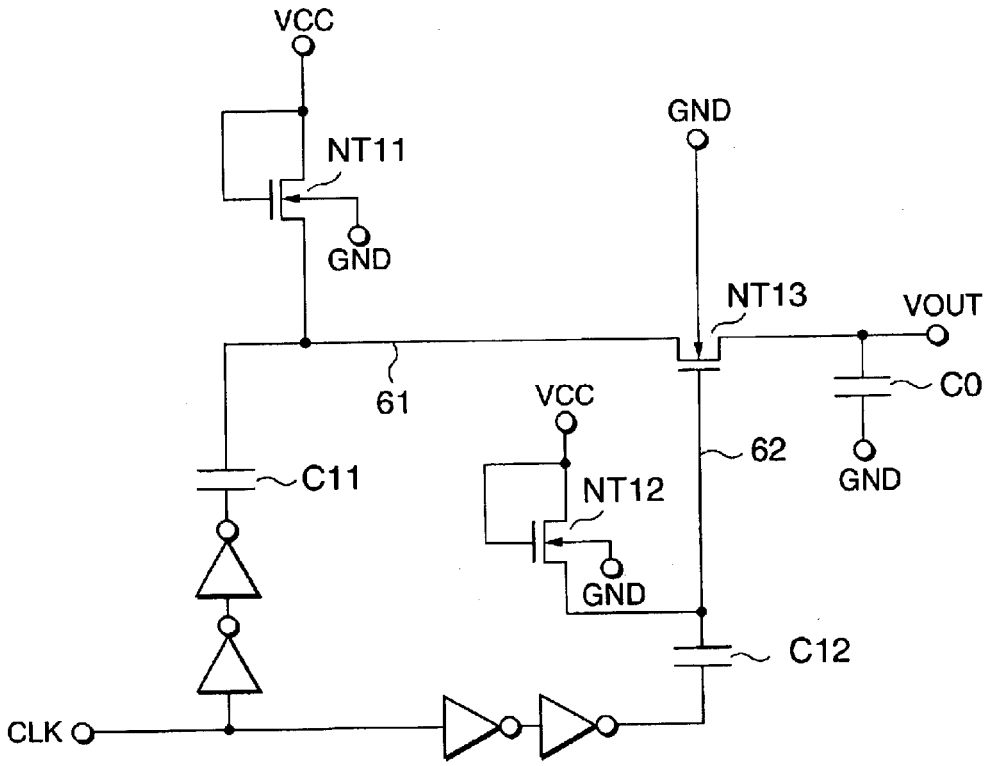
FIG. 1 PRIOR ART
FIG. 1 is a circuit diagram illustrating a conventional bias voltage generating circuit.

As described above, in the bias voltage generating circuit of the embodiment, when current does not flow from the bias voltage generating circuit to the outside, the potential at the bias voltage output terminal VOUT keeps its steady-state potential, 2.times.VCC−(Vt+ΔV). That is, the potential at the bias voltage output terminal VOUT beneficially keeps its steady-state potential larger by the magnitude of (Vt+ΔV). than the corresponding potential achieved when employing the conventional bias voltage generating circuit shown in FIG. 1. When current flows from the bias voltage generating circuit to the outside and then the potential at the bias voltage output terminal VOUT becomes lower than its steady-state potential, the potential at the bias voltage output terminal VOUT again returns to 2.times.VCC−(Vt+ΔV) at the moment the subsequent original clock signal CLK changes to a high level, as is explained in the aforementioned description.

Figure 5:
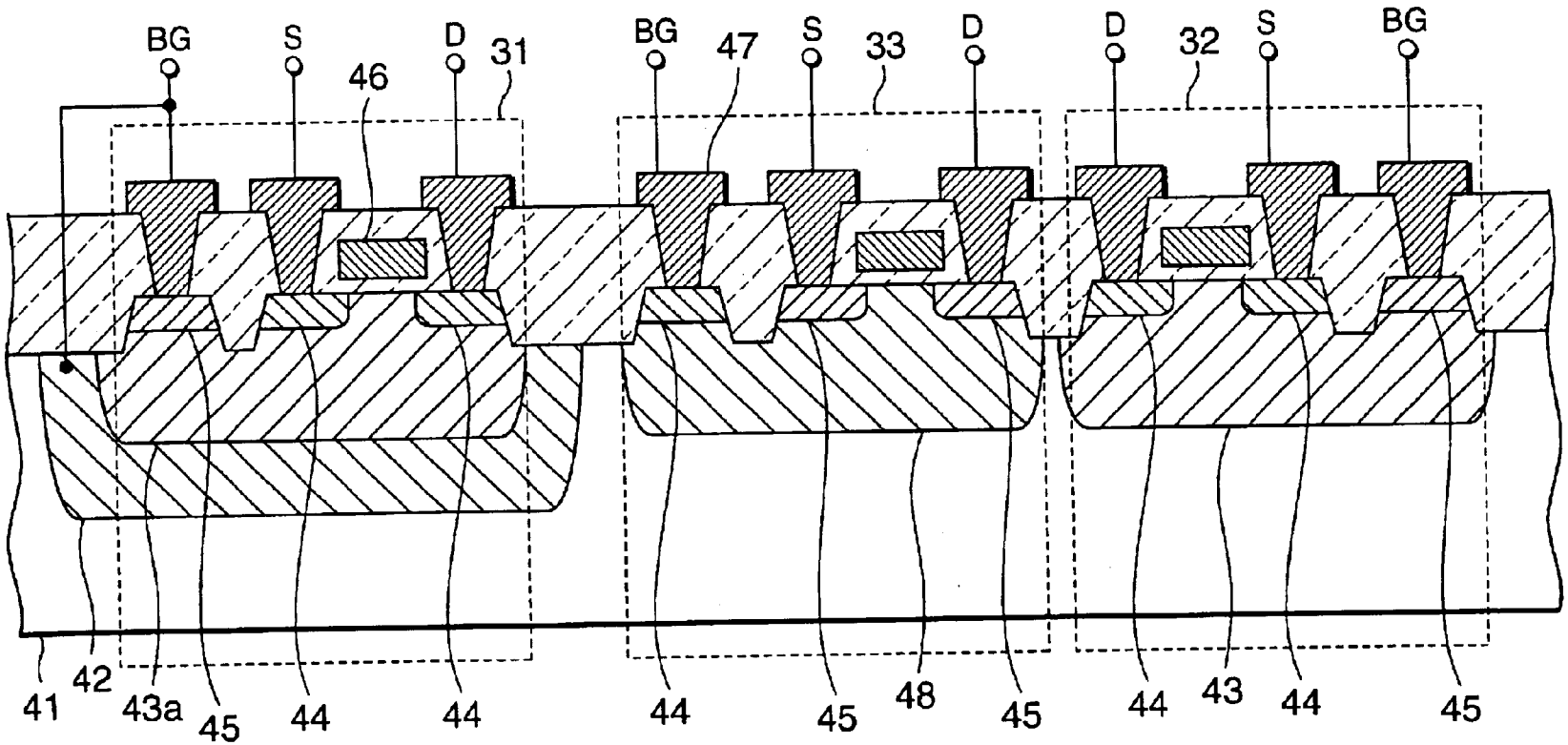
FIG. 5 is a cross sectional view of an example of a semiconductor integrated circuit device incorporating therein the bias voltage generating circuit of the first embodiment.

In the first embodiment shown in FIG. 3, since the N-channel MOS transistor NT5 has its backgate to which VCC is applied, it cannot be formed within the same P-type well as that used to form other N-channel MOS transistors. FIG. 5 is a cross sectional view of an example of a semiconductor integrated circuit device incorporating therein the bias voltage generating circuit of the first embodiment.

An N-channel MOS transistor NT31 corresponds to the N-channel MOS transistor NT5 and is formed in a surface region of a P-type well 43*a* that is formed within a low doped N-type well 42. The potential VCC is applied to the low doped N-type well 42 and the P-type well 43*a* via a backgate terminal BG. An N-channel MOS transistor NT32 corresponds to an N-channel MOS transistor other than the N-channel MOS transistor NT5 and is formed in a surface region of a P-type well 43 that is formed in a P-type semiconductor substrate 41. The potential GND is applied to the P-type well 43 via the backgate terminal BG. A P-channel MOS transistor 33 is formed in a surface region of an N-type well 48 that is formed in the P-type semiconductor substrate 41 and the potential VCC is applied to the N-type well 48 via the backgate terminal BG. A CMOS circuit constituting the clock generating circuit 100, etc., is constructed by using the N-channel MOS transistor 32 and the P-channel MOS transistor 33.

Referring to FIG. 5, numeral 44 denotes a highly doped N-type region that constitutes a source and drain of an N-channel MOS transistor. Numeral 45 denotes a highly doped P-type region that constitutes a source and drain of a P-channel MOS transistor. Numeral 46 denotes a gate electrode and numeral 47 denotes an electrode metal and numeral 49 denotes an insulation film. Furthermore, in each of MOS transistors, sign "BG" denotes a backgate terminal, sign "D" denotes a drain terminal and sign "S" denotes a source terminal.

In the semiconductor integrated circuit device shown in FIG. 5, when the N-channel MOS transistor NT5 is formed in the surface region of the P-type well formed within the low doped N-type well as described above, the N-channel MOS transistor NT5 is positioned remotely from other N-channel MOS transistors and therefore, the semiconductor integrated circuit device is able to incorporate therein the bias voltage generating circuit of the first embodiment in a situation where the N-channel MOS transistor NT5 never adversely affects other N-channel MOS transistors.

Figure 6:
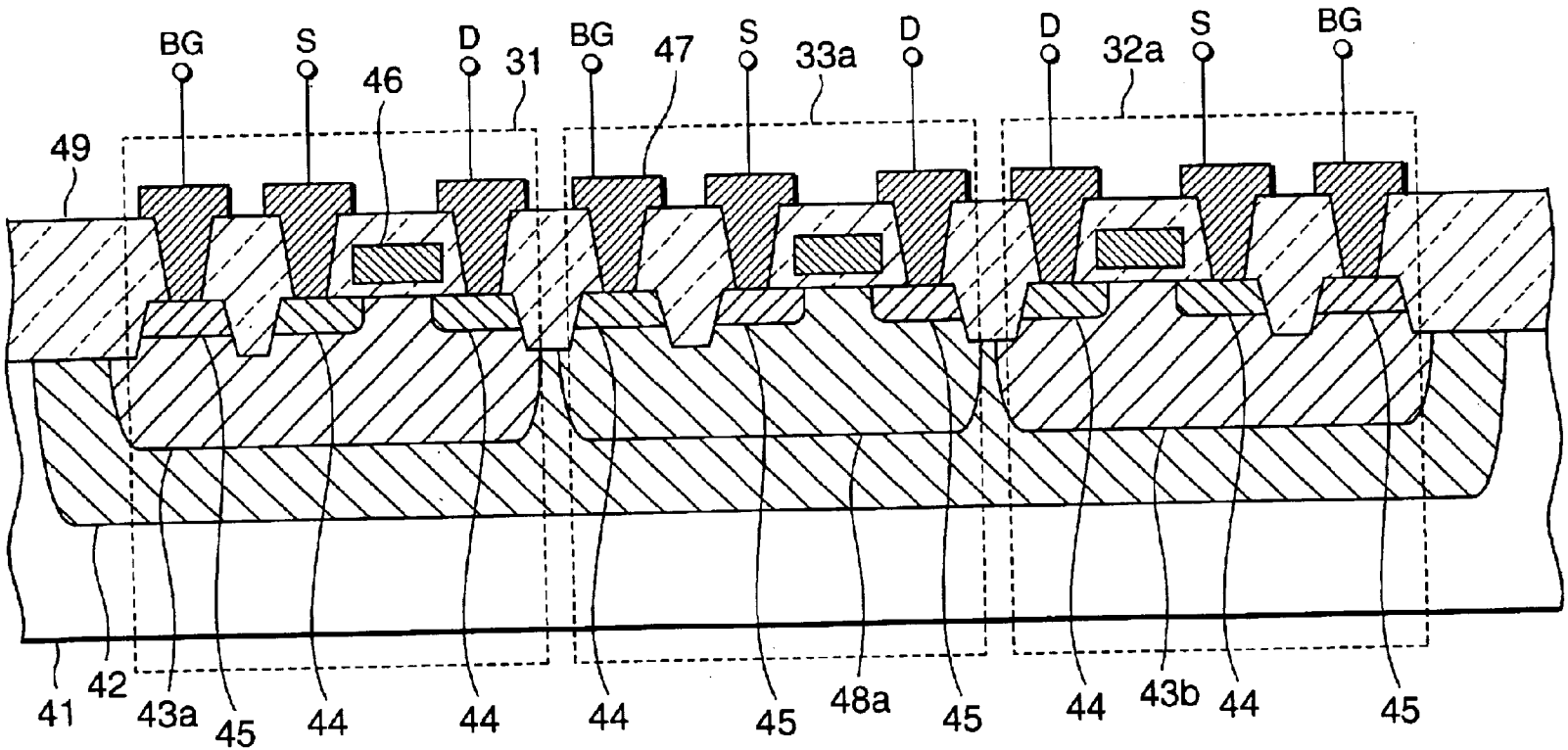
FIG. 6 is a cross sectional view of another example of the semiconductor integrated circuit device incorporating therein the bias voltage generating circuit of the first embodiment.

FIG. 6 is a cross sectional view of another example of the semiconductor integrated circuit device incorporating therein the bias voltage generating circuit of the first embodiment.

In the semiconductor integrated circuit device shown in FIG. 6, the N-channel MOS transistor 31 corresponding to the N-channel MOS transistor NT5, an N-channel MOS transistor 32*a* corresponding to an N-channel MOS transistor other than the N-channel MOS transistor NT5 and a P-channel MOS transistor 33*a* are all formed within a low doped N-type well 42. The N-channel MOS transistor 31 is formed in a surface region of a P-type well 43*a* that is formed within the low doped N-type well 42 and the potential VCC is applied to the P-type well 43*a* via the backgate terminal BG. The N-channel MOS transistor 32*a* is formed in a surface region of a P-type well 43*b* that is formed within the low doped N-type well 42 and the potential GND is applied to the P-type well 43*b* via the backgate terminal BG. The P-channel MOS transistor 33*a* is formed in a surface region of an N-type well 48*a* that is formed within the low doped N-type well 42 and the potential VCC is applied to the N-type well 48*a* via the backgate terminal BG.

In the semiconductor integrated circuit device shown in FIG. 6, the potential of the low doped N-type well is supplied through the backgate terminal BG of the P-channel MOS transistor 33*a* and set at the potential VCC. Accordingly, even when the potential of the P-type well 43*a* of the N-channel MOS transistor 31 is the supply potential VCC and the potential of the P-type well 43*b* of the N-channel MOS transistor 32*a* is the ground potential GND, both N-channel MOS transistors never affect each other. In FIG. 6, numeral 44 denotes a highly doped N-type region; numeral 45 a highly doped P-type region; numeral 46 a gate electrode; numeral 47 an electrode metal; and numeral 49 an insulation film, which correspondence is the same as that observed in FIG. 5.

It should be appreciated that in the bias voltage generating circuit of the first embodiment shown in FIG. 3, the threshold voltage of the N-channel MOS transistor NT3 is preferably made smaller than a forward voltage VF that represents a turn-on voltage appearing across a PN diode consisting of a highly doped N-type region 44 and the P-type well 43*a* when the PN diode is biased in a forward direction. That is, when a potential difference between the source and the backgate of the N-channel MOS transistor NT3 is zero, the threshold voltage of the N-channel MOS transistor NT3 is made smaller than the forward voltage VF appearing across a PN diode consisting of an N-type drain of the N-channel MOS transistor NT3 itself and the P-type well when the PN diode is biased in a forward direction. When the threshold voltage of the N-channel MOS transistor NT3 is larger than the forward voltage VF and the potential of the interconnect line 13 is accidentally made lower than the forward voltage VF, current momentarily flows from the backgate terminal of the N-channel MOS transistor NT5 to the drain terminal thereof through the P-type well. In the extremely rare case, wherein a positional relationship between the N-channel MOS transistor NT5 and transistors surrounding the transistor NT5 is not preferable, the current probably affects the performance of the transistors surrounding the transistor NT5.

Figure 7:
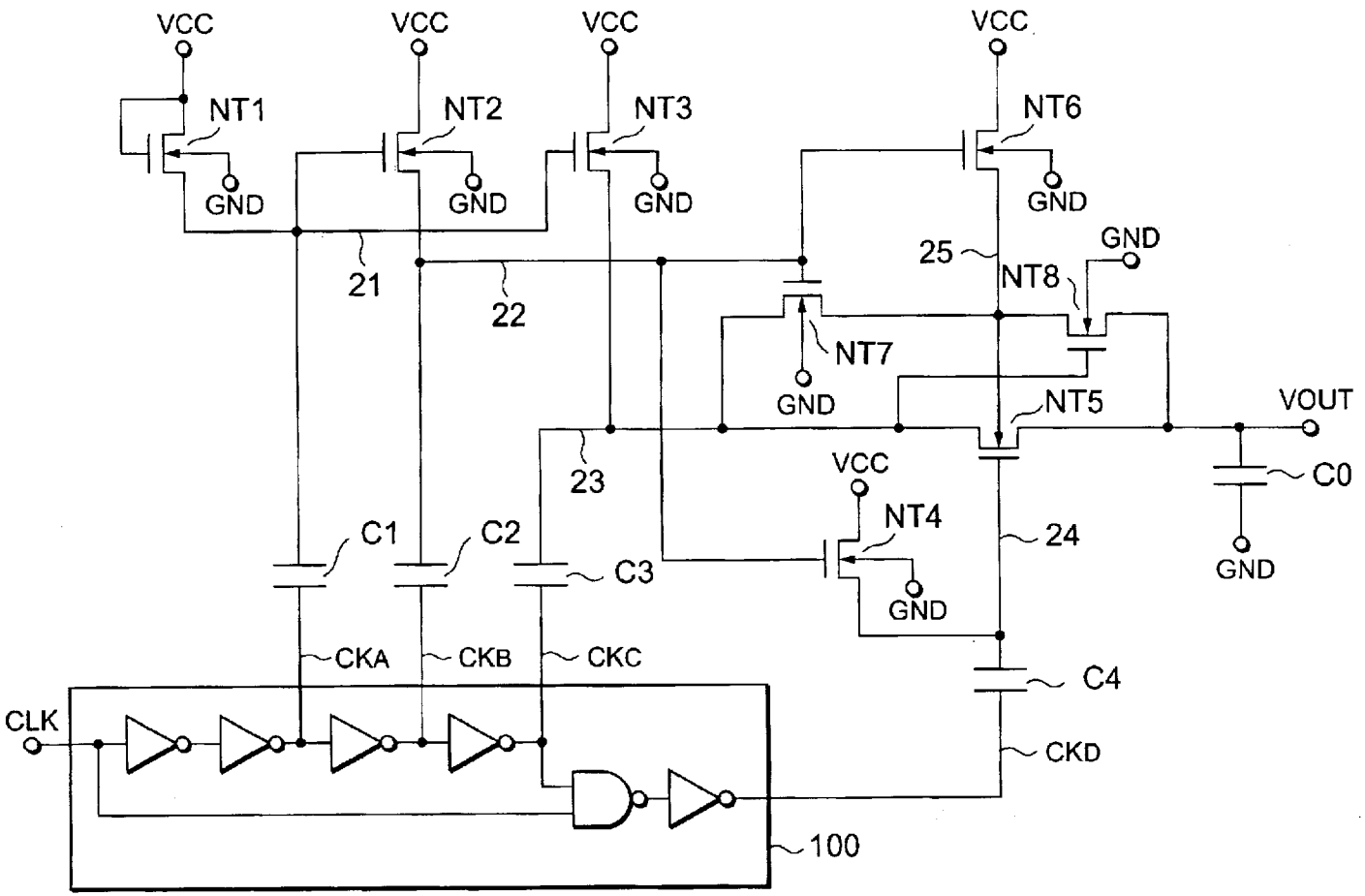
FIG. 7 is a circuit diagram of a bias voltage generating circuit according to a second embodiment of the invention.

A second embodiment of the present invention will be explained below. FIG. 7 is a circuit diagram of a bias voltage generating circuit according to the second embodiment of the invention. Referring to FIG. 7, the bias voltage generating circuit includes N-channel MOS transistors NT1, NT2, NT3, NT4, NT5, NT6, NT7 and NT8, and capacitive elements C1, C2, C3 and C4. Transistors shown in FIG. 7 and corresponding to the transistors included in the first embodiment shown in FIG. 3 are denoted by the same numerals and signs as those used in FIG. 3.

The N-channel MOS transistor NT1 has a drain and a gate connected to a power terminal VCC for supplying a specific positive voltage and a backgate connected to a ground terminal GND.

The N-channel MOS transistor NT2 has a drain connected to the power terminal VCC, a gate connected to the source of the N-channel MOS transistor NT1 via the interconnect line 21, and a backgate connected to the ground terminal GND.

The N-channel MOS transistor NT3 has a drain connected to the power terminal VCC, a gate connected to the source of the N-channel MOS transistor NT1 via the interconnect line 21, and a backgate connected to the ground terminal GND.

The N-channel MOS transistor NT4 has a drain connected to the power terminal VCC, a gate connected to the source of the N-channel MOS transistor NT1 via the interconnect line 22, and a backgate connected to the ground terminal GND.

The N-channel MOS transistor NT5 has a drain connected to the source of the N-channel MOS transistor NT3 via the interconnect line 23, a gate connected to the source of the N-channel MOS transistor NT4 via the interconnect line 24, and a source connected to a bias voltage output terminal VOUT.

The N-channel MOS transistor NT6 has a drain connected to the power terminal VCC, a gate connected to the source of the N-channel MOS transistor NT2 via the interconnect line 22, a source connected to a backgate of the N-channel MOS transistor NT5 via the interconnect line 25, and a backgate connected to the ground terminal GND.

The N-channel MOS transistor NT7 has a drain connected to the source of the N-channel MOS transistor NT3 via the interconnect line 23, a gate connected to the source of the N-channel MOS transistor NT2 via the interconnect line 22, a source connected to the backgate of the N-channel MOS transistor NT5 via the interconnect line 25, and a backgate connected to the ground terminal GND.

The N-channel MOS transistor NT8 has a drain connected to the source of the N-channel MOS transistor NT5, a gate connected to the source of the N-channel MOS transistor NT3 via the interconnect line 23, a source connected to the backgate of the N-channel MOS transistor NT5 via the interconnect line 25, and a backgate connected to the ground terminal GND.

The capacitive element C1 has one end connected to the source of the N-channel MOS transistor NT1 via the interconnect line 11 and the other end to which a clock signal CKA as a first clock signal is supplied.

The capacitive element C2 has one end connected to the source of the N-channel MOS transistor NT2 via the interconnect line 22 and the other end to which a clock signal CKB as a second clock signal having a phase opposite to that of the clock signal CKA is supplied.

The capacitive element C3 has one end connected to the source of the N-channel MOS transistor NT3 via the interconnect line 23 and the other end to which a clock signal CKC as a third clock signal is supplied.

The capacitive element C4 has one end connected to the source of the N-channel MOS transistor NT4 via the interconnect line 24 and the other end to which a clock signal CKD as a fourth clock signal is supplied.

A capacitive element C0 is provided to stabilize a bias voltage to be output. The clock signal CKC begins rising after the clock signal CKA begins rising and the clock signal CKD begins rising after the clock signal CKB begins falling and begins falling before the clock signal CKC begins falling. The clock signals CKA, CKB, CKC and CKD are produced, for example, by a clock generating circuit 100 based on the original clock signal CLK.

Figure 8:
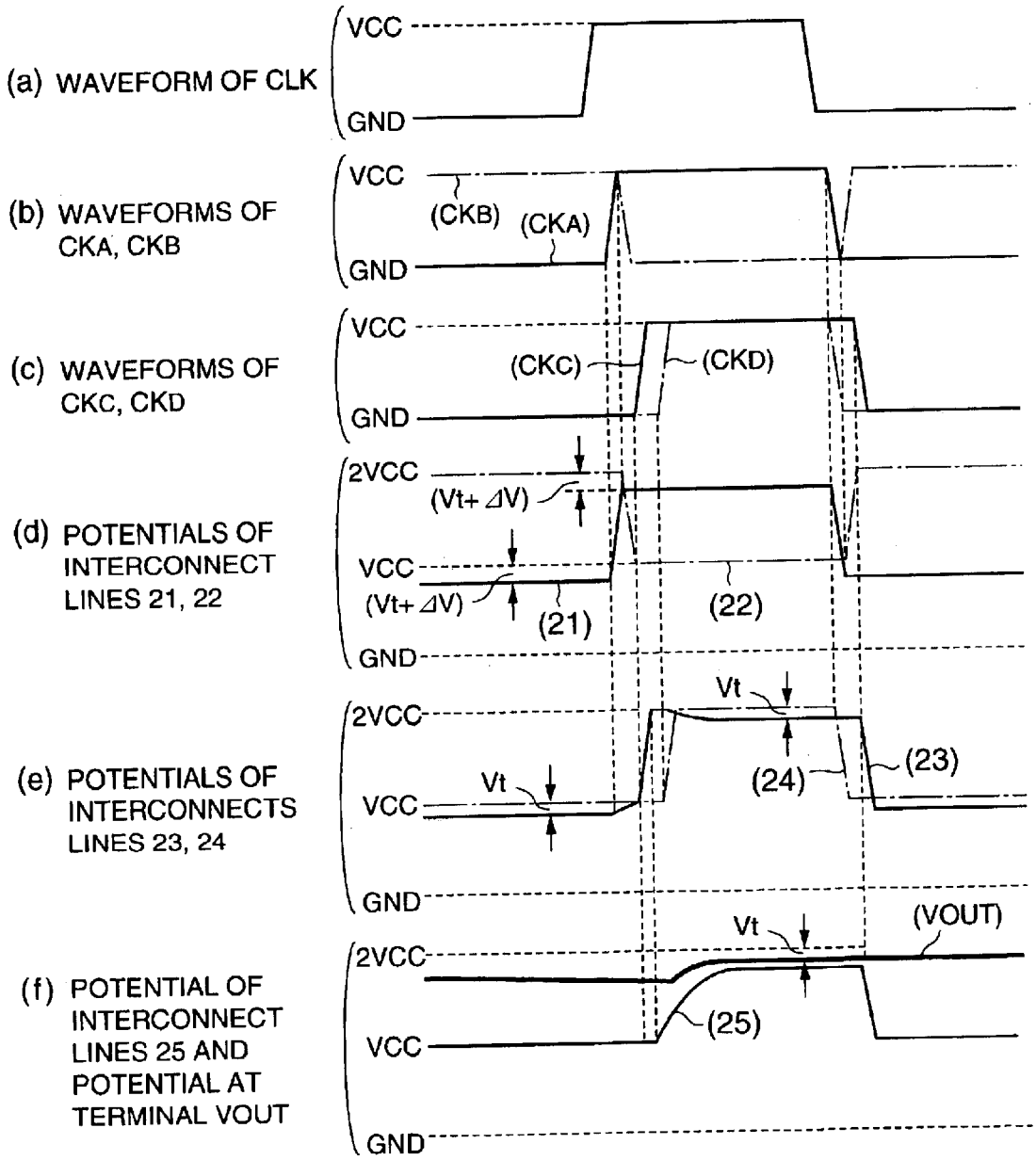
FIG. 8 is a timing diagram of how the bias voltage generating circuit of the second embodiment operates.

FIG. 8 is a timing diagram of how the bias voltage generating circuit of the second embodiment operates. FIG. 8 illustrates how a bias voltage output from the circuit returns to its steady-state bias voltage when the bias voltage output from the circuit is increased to its steady-state voltage and then current flows from the bias voltage generating circuit to the outside, lowering the bias voltage, which operation is explained in the description of the bias voltage generating circuit of the first embodiment shown in FIG. 4.

Referring to FIG. 8, when the original clock signal CLK is at a low level, the clock signal CKA is at the potential GND, the clock signal CKB is at the potential VCC, the clock signal CKC is at the potential GND, and the clock signal CKD is at the potential GND. Furthermore, the interconnect line 21 is at the potential VCC−(Vt+ΔV), the interconnect line 22 is at the potential 2.times.VCC, the interconnect line 23 is at the potential VCC−Vt, the interconnect line 24 is at the potential VCC, and the interconnect line 25 is at the potential VCC. At this moment, the potential at the bias voltage output terminal VOUT is assumed to be lower than its steady-state potential.

When the original clock signal CLK changes to a high level, the clock signal CKA rises to the potential VCC and the clock signal CKB falls to the potential GND. This turns the N-channel MOS transistor NT3 to an ON-state, increasing the potential of the interconnect line 23 from VCC−Vt to VCC, and decreases the potential of the interconnect line 22 from 2.times.VCC to VCC, turning the N-channel MOS transistors NT7, NT6 and NT14 to an OFF-state. When the clock signal CKC rises to the potential VCC after the clock signal CKB has fallen to the potential GND, the potential of the interconnect line 23 increases by the magnitude of VCC to 2.times.VCC. This turns the N-channel MOS transistor NT8 to an ON-state, making the potential of the interconnect line 25 begin increasing from VCC. Subsequently, when the clock signal CKD rises to the potential VCC, the potential of the interconnect line 24 increases from VCC to 2.times.VCC, turning the N-channel MOS transistor NT5 to an ON-state.

When the N-channel MOS transistor NT5 becomes turned on, since an electric charge in the interconnect line 23 moves to the bias voltage output terminal VOUT via the N-channel MOS transistor NT5, the potential at the bias voltage output terminal VOUT increases. Furthermore, since the N-channel MOS transistor NT8 is in an ON-state, as the potential at the bias voltage output terminal VOUT increases, the potential of the interconnect line 25 also increases accordingly. The potential at the bias voltage output terminal VOUT increases up to the potential 2.times.VCC of the interconnect line 24 less the threshold voltage Vt of the N-channel MOS transistor NT5, i. e., 2.times.VCC−Vt, and the potential of the interconnect line 23 decreases down to 2.times.VCC−Vt.

When the original clock signal CLK changes back to a low level, first, the clock signal CKD changes to the potential GND, turning the N-channel MOS transistor NT5 to an OFF-state. Furthermore, the clock signal CKA falls to the potential GND, turning the N-channel MOS transistors NT2 and NT3 to an OFF-state. Since the clock signal CKB rises to the potential VCC, the potential of the interconnect line 22 increases to 2.times.VCC, turning the N-channel MOS transistors NT4, NT6 and NT7 to an ON-state and decreasing the potential of the interconnect line 25 to VCC. Subsequently, when the clock signal CKC falls to the potential GND, the potential of the interconnect line 23 falls from 2.times.VCC−Vt to VCC−Vt. At the moment, since the N-channel MOS transistor NT5 is already in an OFF-state, an electric charge never flows in a reverse direction, i. e., a direction from the bias voltage output terminal VOUT to the interconnect line 23.

As described above, in the bias voltage generating circuit of the second embodiment, when current does not flow from the bias voltage generating circuit to the outside, the potential at the bias voltage output terminal VOUT keeps its steady-state potential, i. e., 2.times.VCC−Vt. That is, the potential at the bias voltage output terminal VOUT in its steady-state condition is beneficially larger by the magnitude of (Vt+2.times.ΔV) than that observed when using the conventional bias voltage generating circuit shown in FIG. 1 and is still larger by the magnitude of ΔV than that observed when using the bias voltage generating circuit of the first embodiment shown in FIG. 3.

In the bias voltage generating circuit of the second embodiment, as can be seen from change in the potential of the interconnect line 25 shown in FIG. 8, the potential at the backgate of the N-channel MOS transistor NT5 changes from VCC nearly up to 2.times.VCC-Vt. Accordingly, the P-type well to which the backgate potential of the N-channel MOS transistor NT5 is supplied needs to be electrically isolated from not only the P-type wells of other N-channel MOS transistors but the N-type wells of the P-channel MOS transistors. Therefore, the semiconductor integrated circuit device incorporating therein the bias voltage generating circuit of the second embodiment needs to have the same configuration as that shown in FIG. 5. That is, the backgate terminal BG of the N-channel MOS transistor 31 corresponding to the N-channel MOS transistor NT5 is connected to the source terminal S of the N-channel MOS transistor 32 corresponding to the N-channel MOS transistor NT6.

Figure 9:
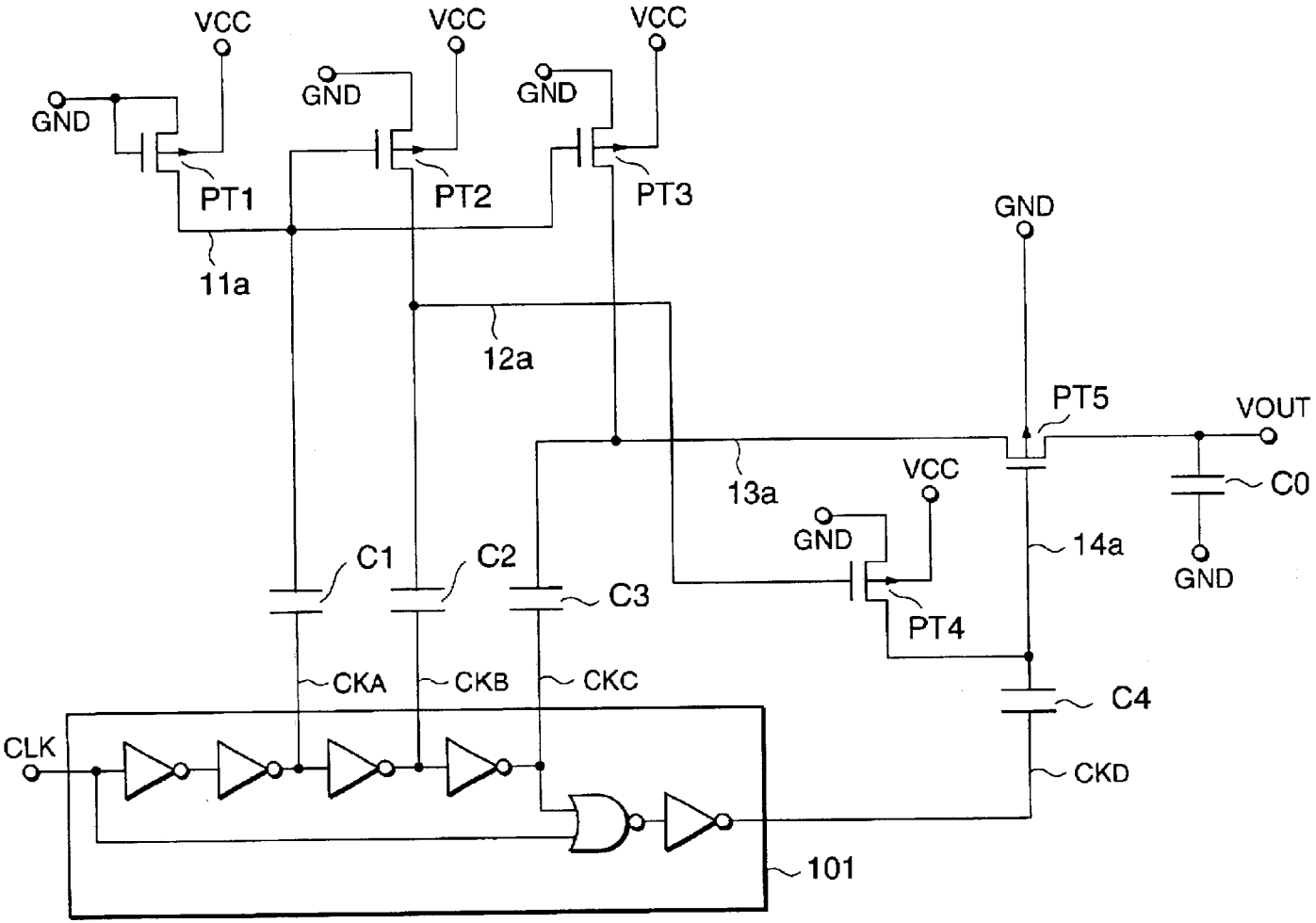
FIG. 9 is a circuit diagram of the bias voltage generating circuit according to a third embodiment of the invention.

A third embodiment of the bias voltage generating circuit of the present invention will be explained below. FIG. 9 is a circuit diagram of the bias voltage generating circuit according to the third embodiment of the invention. The bias voltage generating circuit of the third embodiment is configured to have P-channel MOS transistors instead of the N-channel MOS transistors of the first embodiment and generate a negative potential lower than the ground potential GND. Referring to FIG. 9, the bias voltage generating circuit includes P-channel MOS transistors PT1, PT2, PT3, PT4 and PT5, and capacitive elements C1, C2, C3 and C4.

The P-channel MOS transistor PT1 has a drain and a gate connected to a ground terminal GND, and a backgate connected to a power terminal VCC for supplying a specific positive voltage.

The P-channel MOS transistor PT2 has a drain connected to the ground terminal GND, a gate connected to the source of the P-channel MOS transistor PT1 via the interconnect line 11*a*, and a backgate connected to the power terminal VCC.

The P-channel MOS transistor PT3 has a drain connected to the ground terminal GND, a gate connected to the source of the P-channel MOS transistor PT1 via the interconnect line 11*a*, and a backgate connected to the power terminal VCC.

The P-channel MOS transistor PT4 has a drain connected to the ground terminal GND, a gate connected to the source of the P-channel MOS transistor PT2 via the interconnect line 12*a*, and a backgate connected to the power terminal VCC.

The P-channel MOS transistor PT5 has a drain connected to the source of the P-channel MOS transistor PT3 via the interconnect line 13*a*, a gate connected to the source of the P-channel MOS transistor PT4 via the interconnect line 14*a*, a source connected to a bias voltage output terminal VOUT, and a backgate connected to the ground terminal GND.

The capacitive element C1 has one end connected to the source of the P-channel MOS transistor PT1 via the interconnect line 11*a* and the other end to which a clock signal CKA as a first clock signal is supplied.

The capacitive element C2 has one end connected to the source of the P-channel MOS transistor PT2 via the interconnect line 12*a* and the other end to which a clock signal CKB as a second clock signal having a phase opposite to that of the clock signal CKA is supplied.

The capacitive element C3 has one end connected to the source of the P-channel MOS transistor PT3 via the interconnect line 13*a* and the other end to which a clock signal CKC as a third clock signal is supplied.

The capacitive element C4 has one end connected to the source of the P-channel MOS transistor PT4 via the interconnect line 14*a* and the other end to which a clock signal CKD as a fourth clock signal is supplied.

A capacitive element C0 is provided to stabilize a bias voltage to be output. The clock signal CKC begins falling after the clock signal CKA begins falling and the clock signal CKD begins falling after the clock signal CKB begins rising and begins rising before the clock signal CKC begins rising. The clock signals CKA, CKB, CKC and CKD are produced, for example, by a clock generating circuit 101 based on the original clock signal CLK.

How the bias voltage generating circuit of the third embodiment operates can be explained referring to FIG. 4 and then replacing: GND with VCC; VCC with GND; and 2.times.VCC with (−VCC), and further assuming: change in potential of interconnect line 11 as change in potential of interconnect line 11*a*; change in potential of interconnect line 12 as change in potential of interconnect line 12*a*; change in potential of interconnect line 13 as change in potential of interconnect line 13*a*; and change in potential of interconnect line 14 as change in potential of interconnect line 14*a*. As described above, the bias voltage generating circuit of the third embodiment decreases a voltage to a desired voltage level when the original clock signal CLK begins falling and in its steady-state condition, outputs (−VCC)−(Vt+ΔV) corresponding to 2.times.VCC−(Vt+ΔV), which is the potential at the bias voltage output terminal VOUT of FIG. 4, from the bias voltage output terminal VOUT. Note that since VCC takes a positive value and Vt and ΔV take a negative value, the bias voltage generating circuit of the third embodiment is able to output a negative voltage which is higher by the absolute value of (Vt+ΔV) than (−VCC).

Figure 10:
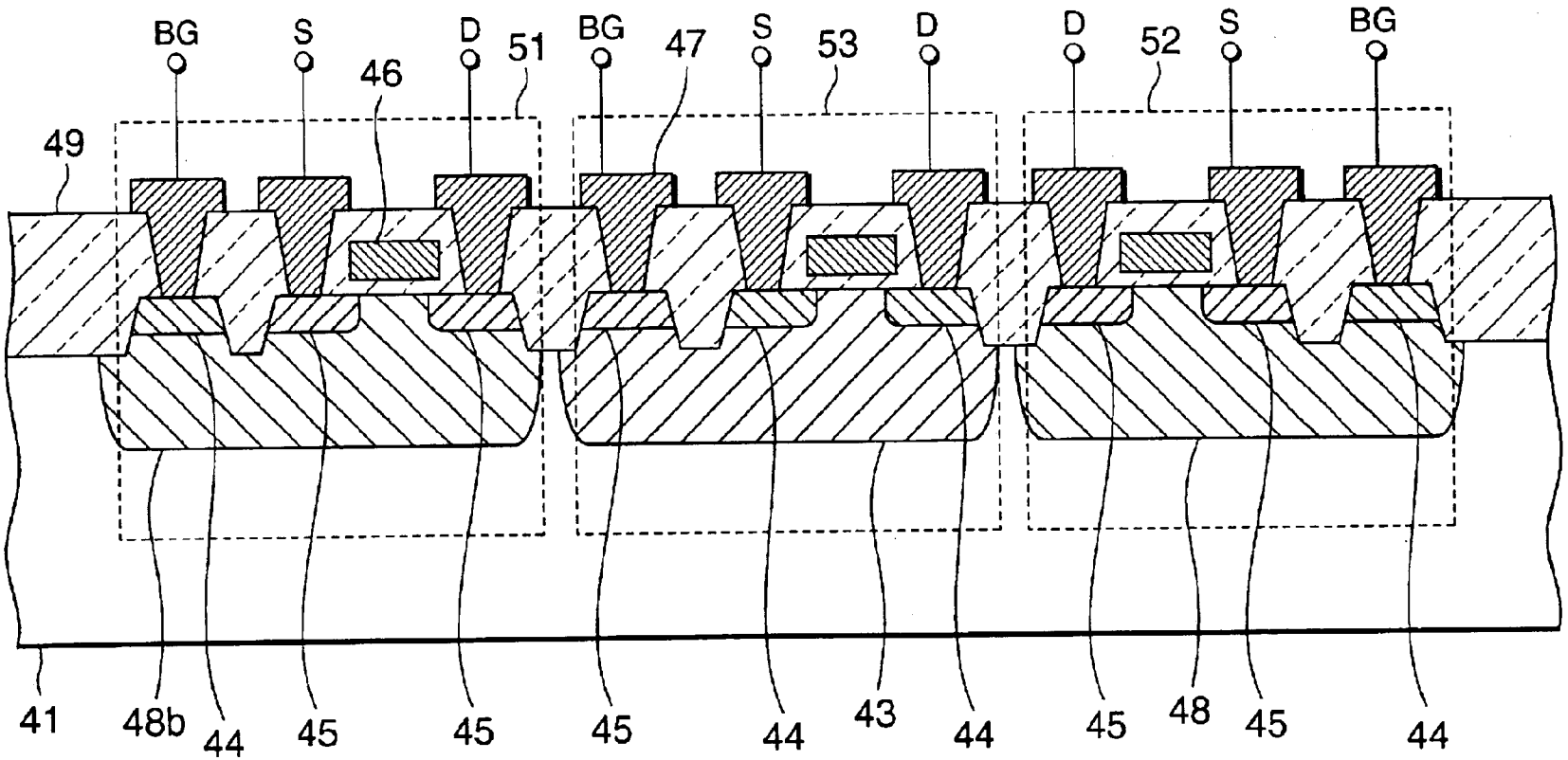
FIG. 10 is a cross sectional view of an example of the semiconductor integrated circuit device incorporating therein the bias voltage generating circuit of the third embodiment.

FIG. 10 is a cross sectional view of an example of the semiconductor integrated circuit device incorporating therein the bias voltage generating circuit of the third embodiment.

In the semiconductor integrated circuit device shown in FIG. 10, a P-channel MOS transistor 51 corresponding to the P-channel MOS transistor PT5 is formed in a surface region of a N-type well 48*b* that is formed in a P-type semiconductor substrate 41 and the ground potential GND is applied to the N-type well 48*b* via a backgate terminal BG. A P-channel MOS transistor 52 corresponding to a P-channel MOS transistor other than the P-channel MOS transistor PT5 is formed in a surface region of a N-type well 48 that is formed in the P-type semiconductor substrate 41 and the potential VCC is applied to the N-type well 48 via the backgate terminal BG. An N-channel MOS transistor 53 is formed in a surface region of a P-type well 43 that is formed in the P-type semiconductor substrate 41 and the ground potential GND is applied to the p-type well 43 via the backgate terminal BG.

In the semiconductor integrated circuit device shown in FIG. 10, the potential of the P-type semiconductor substrate 41 is supplied through the backgate terminal BG of the N-channel MOS transistor 53 and set at the ground potential GND. Accordingly, even when the potential of the N-type well 48*b* of the P-channel MOS transistor 51 is the ground potential GND and the potential of the N-type well 48 of the P-channel MOS transistor 52 is the supply potential VCC, both P-channel MOS transistors never affect each other. In FIG. 10, numeral 44 denotes a highly doped N-type region; numeral 45 a highly doped P-type region; numeral 46 a gate electrode; numeral 47 an electrode metal; and numeral 49 an insulation film, which correspondence is the same as what is observed in FIG. 5.

It should be appreciated that in the bias voltage generating circuit of the third embodiment shown in FIG. 9, the threshold voltage of the P-channel MOS transistor PT3 is preferably made smaller than a forward voltage VF that represents a turn-on voltage appearing across a PN diode consisting of a highly doped P-type region 45 and the N-type well 48*b* when the PN diode is biased in a forward direction. That is, when a potential difference between the source and the backgate of the P-channel MOS transistor PT3 is zero, the threshold voltage of the P-channel MOS transistor PT3 is made smaller in an absolute value than the forward voltage VF appearing across a PN diode consisting of a P-type drain of the P-channel MOS transistor PT3 itself and the N-type well when the PN diode is biased in a forward direction. The reason why the threshold voltage of the P-channel MOS transistor PT3 is set at the above-described value is the same as what is explained in the description of the threshold voltage of the N-channel MOS transistor NT3 of the first embodiment.

Figure 11:
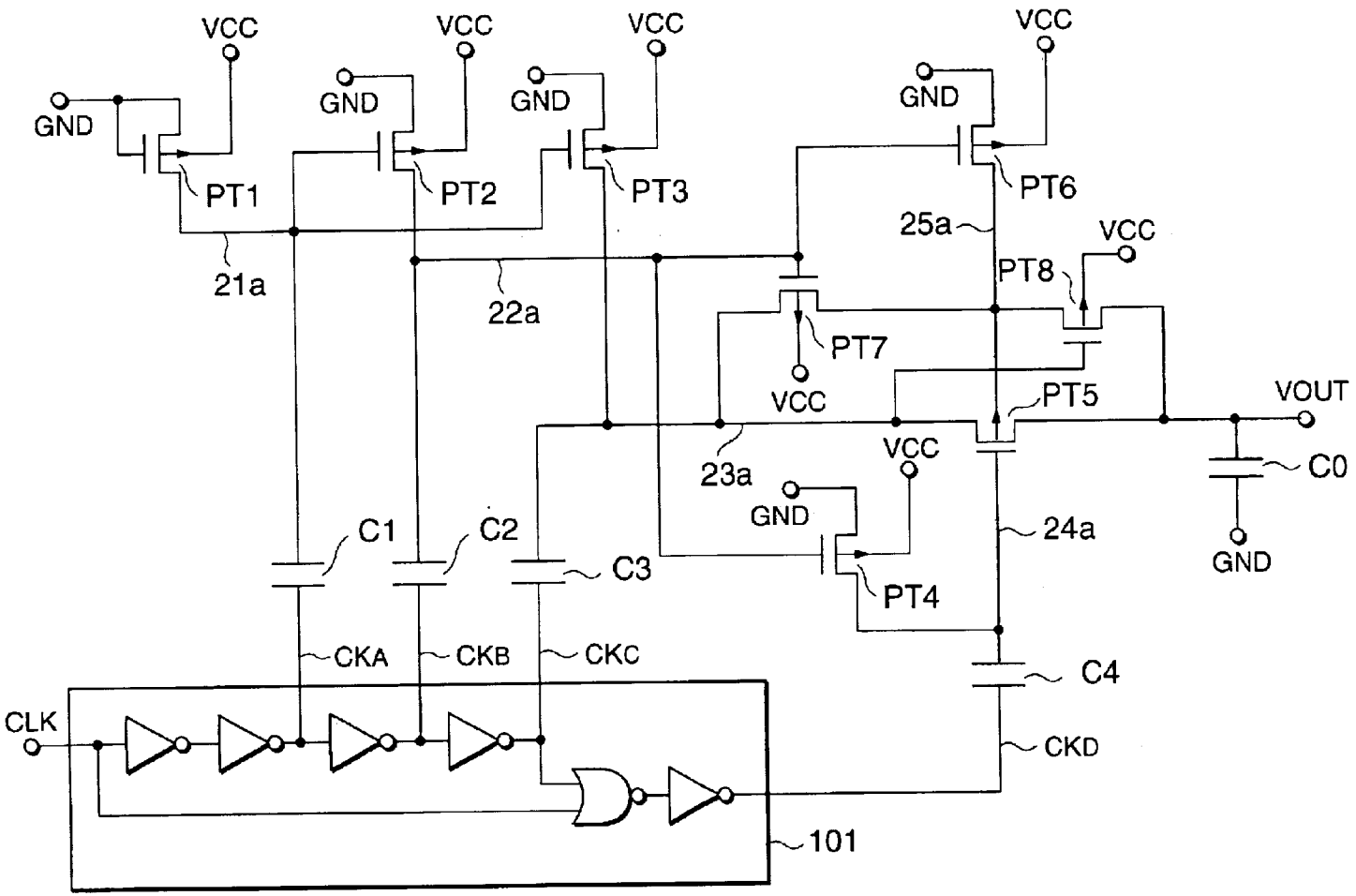
FIG. 11 is a circuit diagram of a bias voltage generating circuit according to a fourth embodiment of the invention.

A fourth embodiment of the present invention will be explained below. FIG. 11 is a circuit diagram of a bias voltage generating circuit according to the fourth embodiment of the invention. The bias voltage generating circuit of the fourth embodiment is configured to have P-channel MOS transistors instead of the N-channel MOS transistors of the second embodiment and generate a negative potential lower than the ground potential GND. Referring to FIG. 11, the bias voltage generating circuit includes P-channel MOS transistors PT1, PT2, PT3, PT4, PT5, PT6, PT7 and PT8, and capacitive elements C1, C2, C3 and C4. Transistors shown in FIG. 11 and corresponding to the transistors included in the third embodiment shown in FIG. 9 are denoted by the same numerals and signs as those used in FIG. 9.

The P-channel MOS transistor PT1 has a drain and a gate connected to a ground terminal GND, and a backgate connected to a power terminal VCC for supplying a specific positive voltage.

The P-channel MOS transistor PT2 has a drain connected to the ground terminal GND, a gate connected to the source of the P-channel MOS transistor PT1 via the interconnect line 21*a*, and a backgate connected to the power terminal VCC.

The P-channel MOS transistor PT3 has a drain connected to the ground terminal GND, a gate connected to the source of the P-channel MOS transistor PT1 via the interconnect line 21*a*, and a backgate connected to the power terminal VCC.

The P-channel MOS transistor PT4 has a drain connected to the ground terminal GND, a gate connected to the source of the P-channel MOS transistor PT2 via the interconnect line 22*a*, and a backgate connected to the power terminal VCC.

The P-channel MOS transistor PT5 has a drain connected to the source of the P-channel MOS transistor PT3 via the interconnect line 23*a*, a gate connected to the source of the P-channel MOS transistor PT4 via the interconnect line 24*a*, and a source connected to a bias voltage output terminal VOUT.

The P-channel MOS transistor PT6 has a drain connected to the ground terminal GND, a gate connected to the source of the P-channel MOS transistor PT2 via the interconnect line 22*a*, a source connected a backgate of the P-channel MOS transistor PT5 via the interconnect line 25*a*, and a backgate connected to the power terminal VCC.

The P-channel MOS transistor PT7 has a drain connected to the source of the P-channel MOS transistor PT3 via the interconnect line 23*a*, a gate connected to the source of the P-channel MOS transistor PT2 via the interconnect line 22*a*, a source connected to the backgate of the P-channel MOS transistor PT5 via the interconnect line 25*a*, and a backgate connected to the power terminal VCC.

The P-channel MOS transistor PT8 has a drain connected to the source of the P-channel MOS transistor PT5, a gate connected to the source of the P-channel MOS transistor PT3 via the interconnect line 23*a*, a source connected to the backgate of the P-channel MOS transistor PT5 via the interconnect line 25*a*, and a backgate connected to the power terminal VCC.

The capacitive element C1 has one end connected to the source of the P-channel MOS transistor PT1 via the interconnect line 21*a* and the other end to which a clock signal CKA as a first clock signal is supplied.

The capacitive element C2 has one end connected to the source of the P-channel MOS transistor PT2 via the interconnect line 22*a* and the other end to which a clock signal CKB as a second clock signal having a phase opposite to that of the clock signal CKA is supplied.

The capacitive element C3 has one end connected to the source of the P-channel MOS transistor PT3 via the interconnect line 23*a* and the other end to which a clock signal CKC as a third clock signal is supplied.

The capacitive element C4 has one end connected to the source of the P-channel MOS transistor PT4 via the interconnect line 24*a* and the other end to which a clock signal CKD as a fourth clock signal is supplied.

A capacitive element C0 is provided to stabilize a bias voltage to be output. The clock signal CKC begins falling after the clock signal CKA begins falling and the clock signal CKD begins falling after the clock signal CKB begins rising and begins rising before the clock signal CKC begins rising. The clock signals CKA, CKB, CKC and CKD are produced, for example, by a clock generating circuit 101 based on the original clock signal CLK.

How the bias voltage generating circuit of the fourth embodiment operates can be explained referring to FIG. 8 and then replacing: GND with VCC; VCC with GND; and 2.times.VCC with (−VCC), and further assuming: change in potential of interconnect line 21 as change in potential of interconnect line 21*a*; change in potential of interconnect line 22 as change in potential of interconnect line 22*a*; change in potential of interconnect line 23 as change in potential of interconnect line 23*a*; change in potential of interconnect line 24 as change in potential of interconnect line 24*a*; and change in potential of interconnect line 25 as change in potential of interconnect line 25*a*. As described above, the bias voltage generating circuit of the fourth embodiment decreases a voltage to a desired voltage when the original clock signal CLK begins falling and in its steady-state condition, outputs (−VCC)−Vt corresponding to 2.times.VCC−Vt, which is the potential at the bias voltage output terminal VOUT of FIG. 8, from the bias voltage output terminal VOUT. Note that since VCC takes a positive value and both Vt and ΔV take a negative value, the bias voltage generating circuit of the fourth embodiment is able to output a negative voltage that is higher by the absolute value of Vt than (−VCC). The bias voltage generating circuit of the fourth embodiment can be incorporated in the semiconductor integrated circuit by: forming a low doped P-type well in an N-type semiconductor substrate; and forming an N-type well within the low doped P-type well; and then forming a P-channel MOS transistor PT5 in a surface region of the N-type well.

As described so far, the present invention is able to provide an improved bias voltage generating circuit capable of reducing an extent to which a voltage output from a bias voltage output terminal is lowered in conjunction with the effect of threshold voltage of an N-channel MOS transistor and generating a bias voltage higher than that obtained using the conventional technique even under application of a low supply voltage, and further to provide a semiconductor integrated circuit device incorporating therein the improved bias voltage generating circuit. Furthermore, the present invention is able to provide an improved bias voltage generating circuit capable of generating a negative bias voltage lower than that obtained using the conventional technique even under application of a low supply voltage, and further to provide a semiconductor integrated circuit device incorporating therein the improved bias voltage generating circuit.

What is claimed is:

1. A bias voltage generating circuit comprising:

a first power terminal for receiving a first voltage from outside;

a second power terminal for receiving a second voltage from the outside;

a bias voltage output terminal for outputting a bias voltage to the outside;

a first MOS transistor having a drain and a gate connected to the first power terminal and a backgate connected to the second power terminal;

a second MOS transistor having a drain connected to the first power terminal, a gate connected to the source of the first-MOS transistor, and a backgate connected to the second power terminal;

a third MOS transistor having a drain connected to the first power terminal, a gate connected to the source of the first MOS transistor, and a backgate connected to the second power terminal;

a fourth MOS transistor having a drain connected to the first power terminal, a gate connected to the source of the second MOS transistor, and a backgate connected to the second power terminal;

a fifth MOS transistor having a drain connected to the source of the third MOS transistor, a gate connected to the source of the fourth MOS transistor, a source connected to the bias voltage output terminal, and a backgate connected to the first power terminal;

a first capacitive element having one end connected to the source of the first MOS transistor and the other end for receiving a first clock signal;

a second capacitive element having one end connected to the source of the second MOS transistor and the other end for receiving a second clock signal having a phase opposite to that of the first clock signal;

a third capacitive element having one end connected to the source of the third MOS transistor and the other end for receiving a third clock signal; and a fourth capacitive element having one end connected to the source of the fourth MOS transistor and the other end for receiving a fourth clock signal.

2. The bias voltage generating circuit according to claim 1, wherein the first voltage is a specific positive voltage and the second voltage is a ground voltage, and the first through fifth MOS transistors are each an N-channel MOS transistor.

3. The bias voltage generating circuit according to claim 2, wherein the third clock signal begins rising after the first clock signal begins rising and the fourth clock signal begins rising after the second clock signal begins falling and begins falling before the third clock signal begins falling.

4. The bias voltage generating circuit according to claim 2, wherein a threshold voltage of the third MOS transistor observed when a potential difference between the source and the backgate of the third MOS transistor is zero is smaller than a forward voltage appearing across a PN diode consisting of the drain of the third MOS transistor and a P-type well.

5. The bias voltage generating circuit according to claim 1, wherein the first voltage is a ground voltage and the second voltage is a specific positive voltage, and the first through fifth MOS transistors are each a P-channel MOS transistor.

6. The bias voltage generating circuit according to claim 5, wherein the third clock signal begins falling after the first clock signal begins falling and the fourth clock signal begins falling after the second clock signal begins rising and begins rising before the third clock signal begins rising.

7. The bias voltage generating circuit according to claim 5, wherein a threshold voltage of the third MOS transistor observed when a potential difference between the source and the backgate of the third MOS transistor is zero is smaller in an absolute value than a forward voltage appearing across a PN diode consisting of the drain of the third MOS transistor and an N-type well.

8. A bias voltage generating circuit comprising:

a first power terminal for receiving a first voltage from outside;

a second power terminal for receiving a second voltage from the outside;

a bias voltage output terminal for outputting a bias voltage to the outside;

a first MOS transistor having a drain and a gate connected to the first power terminal, and a backgate connected to the second power terminal;

a second MOS transistor having a drain connected to the first power terminal, a gate connected to the source of the first MOS transistor, and a backgate connected to the second power terminal;

a third MOS transistor having a drain connected to the first power terminal, a gate connected to the source of the first MOS transistor, and a backgate connected to the second power terminal;

a fourth MOS transistor having a drain connected to the first power terminal, a gate connected to the source of the second MOS transistor, and a backgate connected to the second power terminal;

a fifth MOS transistor having a drain connected to the source of the third MOS transistor, a gate connected to the source of the fourth MOS transistor, and a source connected to the bias voltage output terminal;

a sixth MOS transistor having a drain connected to the first power terminal, a gate connected to the source of the second MOS transistor, a source connected to a backgate of the fifth MOS transistor, and a backgate connected to the second power terminal;

a seventh MOS transistor having a drain connected to the source of the third MOS transistor, a gate connected to the source of the second MOS transistor, a source connected to the backgate of the fifth MOS transistor, and a backgate connected to the second power terminal;

an eighth MOS transistor having a drain connected to the source of the fifth MOS transistor, a gate connected to the source of the third MOS transistor, a source connected to the backgate of the fifth MOS transistor, and a backgate connected to the second power terminal;

a first capacitive element having one end connected to the source of the first MOS transistor and the other end for receiving a first clock signal;

a second capacitive element having one end connected to the source of the second MOS transistor and the other end for receiving a second clock having a phase opposite to that of the first clock signal;

a third capacitive element having one end connected to the source of the third MOS transistor and the other end for receiving a third clock signal; and a fourth capacitive element having one end connected to the source of the fourth MOS transistor and the other end for receiving a fourth clock signal.

9. The bias voltage generating circuit according to claim 8, wherein the first voltage is a specific positive voltage and the second voltage is a ground voltage, and the first through eighth MOS transistors are each an N-channel MOS transistor.

10. The bias voltage generating circuit according to claim 9, wherein the third clock signal begins rising after the first clock signal begins rising and the fourth clock signal begins rising after the second clock signal begins falling and begins falling before the third clock signal begins falling.

11. The bias voltage generating circuit according to claim 8, wherein the first voltage is a ground voltage and the second voltage is a specific positive voltage, and the first through eighth MOS transistors are each a P-channel MOS transistor.

12. The bias voltage generating circuit according to claim 11, wherein the third clock signal begins falling after the first clock signal begins falling and the fourth clock signal begins falling after the second clock signal begins rising and begins rising before the third clock signal begins rising.

13. A semiconductor integrated circuit device comprising a bias voltage generating circuit, the bias voltage generating circuit including:

a power terminal for receiving a specific positive voltage;

a ground terminal for receiving a ground voltage;

a bias voltage output terminal for outputting a bias voltage;

a first N-channel MOS transistor having a drain and a gate connected to the power terminal, and a backgate connected to the ground terminal;

a second N-channel MOS transistor having a drain connected to the power terminal, a gate connected to the source of the first N-channel MOS transistor, and a backgate connected to the ground terminal;

a third N-channel MOS transistor having a drain connected to the power terminal, a gate connected to the source of the first N-channel MOS transistor, and a backgate connected to the ground terminal;

a fourth N-channel MOS transistor having a drain connected to the power terminal, a gate connected to the source of the second N-channel MOS transistor, and a backgate connected to the ground terminal;

a fifth N-channel MOS transistor having a drain connected to the source of the third N-channel MOS transistor, a gate connected to the source of the fourth N-channel MOS transistor, a source connected to the bias voltage output terminal, and provided in a surface region of a P-type well formed within a low doped N-type well;

a sixth N-channel MOS transistor having a drain connected to the power terminal, a gate connected to the source of the second N-channel MOS transistor, a source connected to a backgate of the fifth N-channel MOS transistor, and a backgate connected to the ground terminal;

a seventh N-channel MOS transistor having a drain connected to the source of the third N-channel MOS transistor, a gate connected to the source of the second N-channel MOS transistor, a source connected to the backgate of the fifth N-channel MOS transistor, and a backgate connected to the ground terminal; and an eighth N-channel MOS transistor having a drain connected to the source of the fifth N-channel MOS transistor, a gate connected to the source of the third N-channel MOS transistor, a source connected to the backgate of the fifth N-channel MOS transistor, and a backgate connected to the ground terminal.

* * * * *